US005280897A

United States Patent [19]

Maekawa

[11] Patent Number: 5,280,897

[45] Date of Patent: Jan. 25, 1994

[54] PAPER-RESUPPLYING DEVICE IN IMAGE-FORMING APPARATUS

[75] Inventor: Takashi Maekawa, Osaka, Japan

[73] Assignee: Mita Industrial Co., Ltd., Osaka, Japan

[21] Appl. No.: 1,420

[22] Filed: Jan. 7, 1993

Related U.S. Application Data

[63] Continuation of Ser. No. 769,853, Oct. 2, 1991, abandoned.

[30] Foreign Application Priority Data

Oct. 16, 1990 [JP] Japan ..... 2-277036

[51] Int. Cl.[5] ..... B65H 5/22; B65H 31/00

[52] U.S. Cl. ..... 271/3.1; 271/207; 271/209; 271/223

[58] Field of Search ..... 271/3.1

[56] References Cited

U.S. PATENT DOCUMENTS

| | | | |
|---|---|---|---|
| 4,939,554 | 7/1990 | Hirabayashi et al. | 355/317 |
| 4,941,654 | 7/1990 | Kelley | 271/209 |
| 4,954,849 | 9/1990 | Koike et al. | 271/3.1 |
| 4,978,111 | 12/1990 | Kosugi et al. | 271/3.1 |
| 5,092,576 | 4/1993 | Takahashi | 271/3.1 |
| 5,132,720 | 7/1992 | Kioka et al. | 355/24 |

FOREIGN PATENT DOCUMENTS

| | | | |
|---|---|---|---|
| 4002785A1 | 8/1990 | Fed. Rep. of Germany . | |
| 166262 | 10/1982 | Japan | 271/207 |
| 185767 | 8/1988 | Japan | 271/3.1 |
| 185768 | 8/1988 | Japan | 271/3.1 |

*Primary Examiner*—H. Grant Skaggs
*Attorney, Agent, or Firm*—Wenderoth, Lind & Ponack

[57] ABSTRACT

The distance between a paper discharging portion and an intermediate tray in a paper discharging device is increased, thus increasing the quantity of papers stacked in the intermediate tray, and also allowing the easy correction of jamming and preventing curling downwardly and rearwardly of papers discharged from the paper discharging portion.

12 Claims, 7 Drawing Sheets

PAPER-RESUPPLYING DEVICE IN IMAGE-FORMING APPARATUS

This application is a continuation of now abandoned application Ser. No. 07/769,853 filed Oct. 2, 1991.

BACKGROUND OF THE INVENTION

1. Field of the Invention

The present invention relates to an improvement of a paper resupplying device installed in an image forming apparatus capable of superposing copy images on one side of a paper and forming an image on both sides of the paper, that is forming a so-called composite image.

2. Description of the Prior Art

In order to form a so-called composite image on one side or both sides of a paper, a paper resupplying device in an image forming apparatus has been provided with an intermediate tray for stacking papers after forming one image thereon and a paper discharging device for discharging the papers onto the intermediate tray after the one image is formed thereon, such that the papers descend forwardly during such discharge.

In such paper resupplying device, if the distance between a paper discharging position from the paper discharging device and the intermediate tray is increased, the quantity of papers stacked in the intermediate tray can be increased, and thus jamming easily can be corrected.

However, when the papers discharged from the paper discharging position descend forwardly, due to a thermal effect in a preceding fixing operation or treatment, the possibility exists that simultaneously both corner portions of the leading end of each paper are bent downwardly toward the lower surface thereof. Thus, opposite corner portions (c) of the leading end (d) of the paper (a) curl downwardly causing leading end (d) of the paper to curl under rearwardly. Thus, the paper takes the shape of turned-over letter "C" as seen from the leading end of the paper and the paper is discharged under the condition that it descends forwardly an curls under rearward, as shown in FIG. 8.

If the distance from the paper discharging position to the intermediate tray 21 is increased to increase the quantity of papers (a) stacked and to take correction of jamming into consideration, there occurs the further possibility that the flat leading end (d) will engage with the intermediate tray 21 at a right angle with a surface of the tray or will be rolled rearwardly at corner portions (c). As a result, not only does the leading edge of the flat end (d) and both corner portions (c) of the paper cause increased conveying resistance, but also the papers (a) are discharged successively under a condition such that they tend to fall forwardly and roll under rearwardly, such that jamming occurs.

In case particularly of small size papers, a curled portion is larger proportionally than a non-curled portion, in the width-wise direction, compared with large size papers. Thus, the above described turned-over letter "C" condition can approach a "O" letter condition. That is, the condition of falling forward and curling under becomes even more notable.

Also, there has been proposed a paper discharging device including a plurality of paper discharging portions for discharging papers to the intermediate tray, with the respective paper discharging portions other than that on the downstream end in the paper discharging direction being provided with a paper discharging guide movable to a posture allowing papers to pass in the downstream direction.

The paper discharging portions in this type of paper discharging device generally are provided at three places, for example an upstream end, a downstream end and a midway position in the paper discharging direction. Large size papers are passed to the intermediate tray by moving the upstream end to said paper discharging guide to the paper discharging posture thereof. Middle size papers are passed to the intermediate tray by moving the middle paper discharging guide to the paper discharging posture thereof. Small size papers are passed to the intermediate tray from the downstream paper discharging portion by moving both of the paper discharging guides to postures thereof allowing the papers to pass.

In a paper resupplying device provided with paper discharging device having such construction, a reduced distance between the paper discharging device and the intermediate tray has been employed to avoid curling downwardly of small size papers which are discharged to the intermediate tray under the worst conditions, as a standard.

However, if such distance is reduced in such manner, a disadvantage occurs in that it is difficult to correct jamming occurring between the paper discharging device and the intermediate tray.

Also, there has been proposed a device provided with distance changing means to widen such distance as needed. However, problems result in that not only is the device of a large size and manufacturing costs are increased, but also jamming occurs if an operator forgets to return the distance changing means to the original distance.

SUMMARY OF THE INVENTION

The present invention has been achieved in view of the above described actual circumstances, and it is a first object of the present invention to prevent curling downwardly and rearwardly of paper discharged to an intermediate tray. It is a second object of the present invention to provide for easy correction or disposition of jamming between a paper discharging device and the intermediate tray, without requiring large scale distance changing means, and simultaneously to prevent such curling downwardly and rearwardly paper from occurring.

In order to achieve the above first object, a first aspect of the invention provides a paper resupplying device in an image forming apparatus provided with an intermediate tray for stacking papers after forming an image thereon and a paper discharging device for discharging the papers to the intermediate tray, wherein the intermediate tray is provided with an upwardly projecting member to be engaged by a leading end of the paper discharged from the paper discharging device.

In order to achieve the above second object, a second of the invention provides a paper resupplying device, wherein a paper discharging device is provided with a plurality of paper discharging portions for an intermediate tray. The intermediate tray is provided with an upwardly projecting member to be engaged by a leading end of a paper discharged from the paper discharging portions. Such a member is provided in correspondence to at least one paper discharging portion located at a downstream end in a paper discharging direction, among the plurality of paper discharging portions.

According to the first aspect of the invention, a distance from the leading end of a paper discharged from the paper discharging portion to the intermediate tray is reduced by the distance the projecting member projects from the intermediate tray, and thus curling downwardly and rearwardly of the paper can be prevented.

According to the second aspect of the invention, the projecting member is provided in correspondence to or aligned with the paper discharging portion for small size papers discharged under the worst condition, whereby curling downwardly and rearwardly of the paper from such paper discharging portion can be prevented.

Accordingly, jamming between the paper discharging device and the intermediate tray easily can be corrected, while still preventing curling downwardly and rearwardly, by widening the distance between the paper discharging device and the intermediate tray as much as possible so long as paper discharged from other paper discharging portions does not fall forwardly, or still further widening such distance and simultaneously providing the projecting members in correspondence to or aligned with respective paper discharging portions.

BRIEF DESCRIPTION OF THE DRAWINGS

Preferred embodiments of the present invention will be described below with reference to the accompanying drawings, wherein.

DESCRIPTION OF THE PREFERRED EMBODIMENTS

Figure 1:
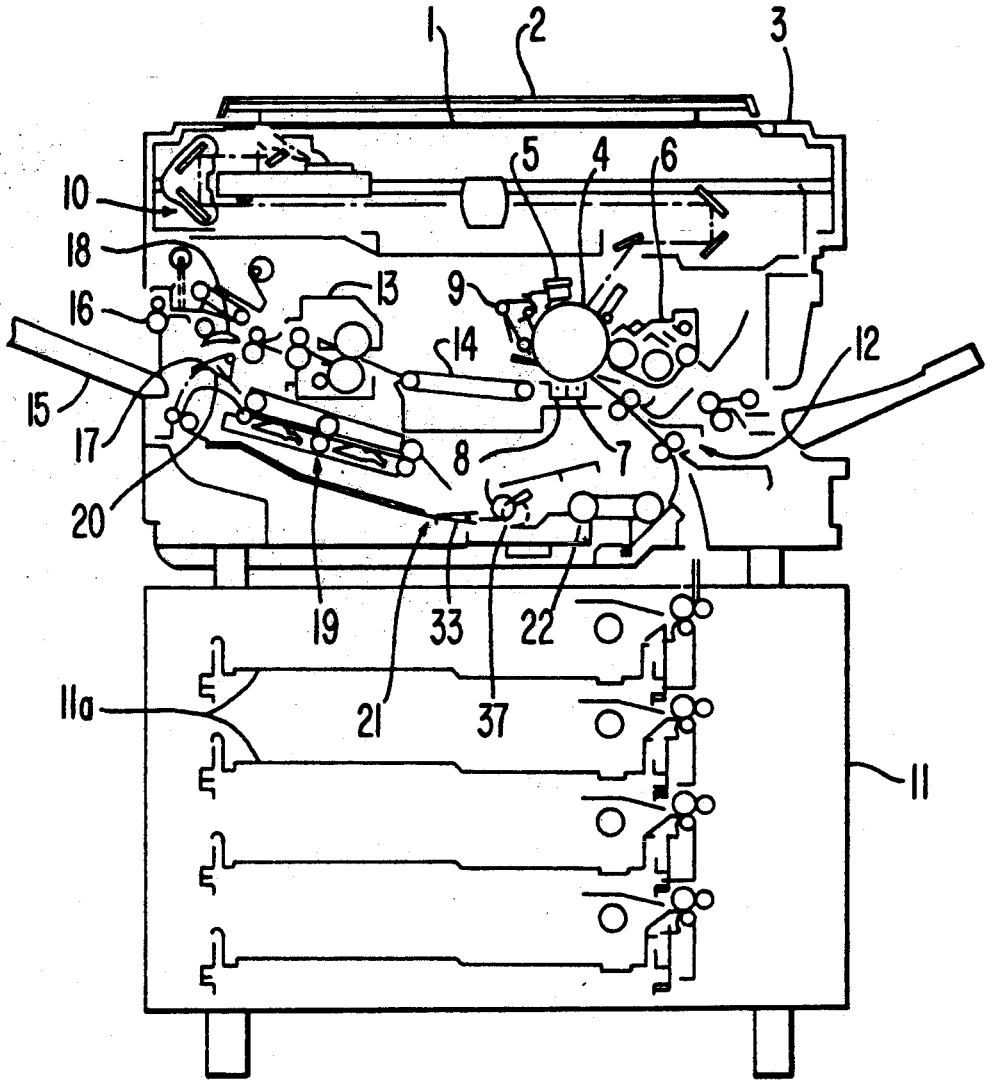
FIG. 1 is a schematic longitudinally sectioned side view showing an electrostatic photographic copying machine as one example of an image-forming apparatus.

FIG. 1 shows an electrostatic photographic copying machine as one example of an image-forming apparatus and including a body case 3 provided with a manuscript receiving table 1 and manuscript pressing means 2. A photoreceptor 4 is positioned within body case 3, and a charging device 5, a developing device 6, a transfer device 7, a paper separating device 8 and a cleaning device 9 are arranged in the direction of rotation of photoreceptor 4 in the order described around the photoreceptor 4. An exposing device 10 of the movable optical system type is arranged in an upper space of the body case 3. A paper supplying and conveying device 12 conveys papers housed in cassettes 11*a* of a paper-supplying deck 11 to transfer device 7. A paper discharging and conveying device 14 conveying transferred and separated papers to a fixing device 13 and to a pair of paper discharging rollers 16 for discharging fixed papers to a tray 15.

A first passage change-over member 18 passes a paper having one image fixed thereon to a paper resupplying passage 17. A second passage change-over member 20 supplies a paper taken previously supplied to paper resupplying passage 17 to a paper discharging device 19. An intermediate tray 21 receives and stacks papers discharged from paper discharging device 19. A width arranging mechanism 37 arranges papers tacked in intermediate tray 21 in the widthwise direction thereof. Paper resupplying means 22 supplies the papers stacked in the intermediate tray 21 to paper supplying and conveying device 12.

Figure 2:
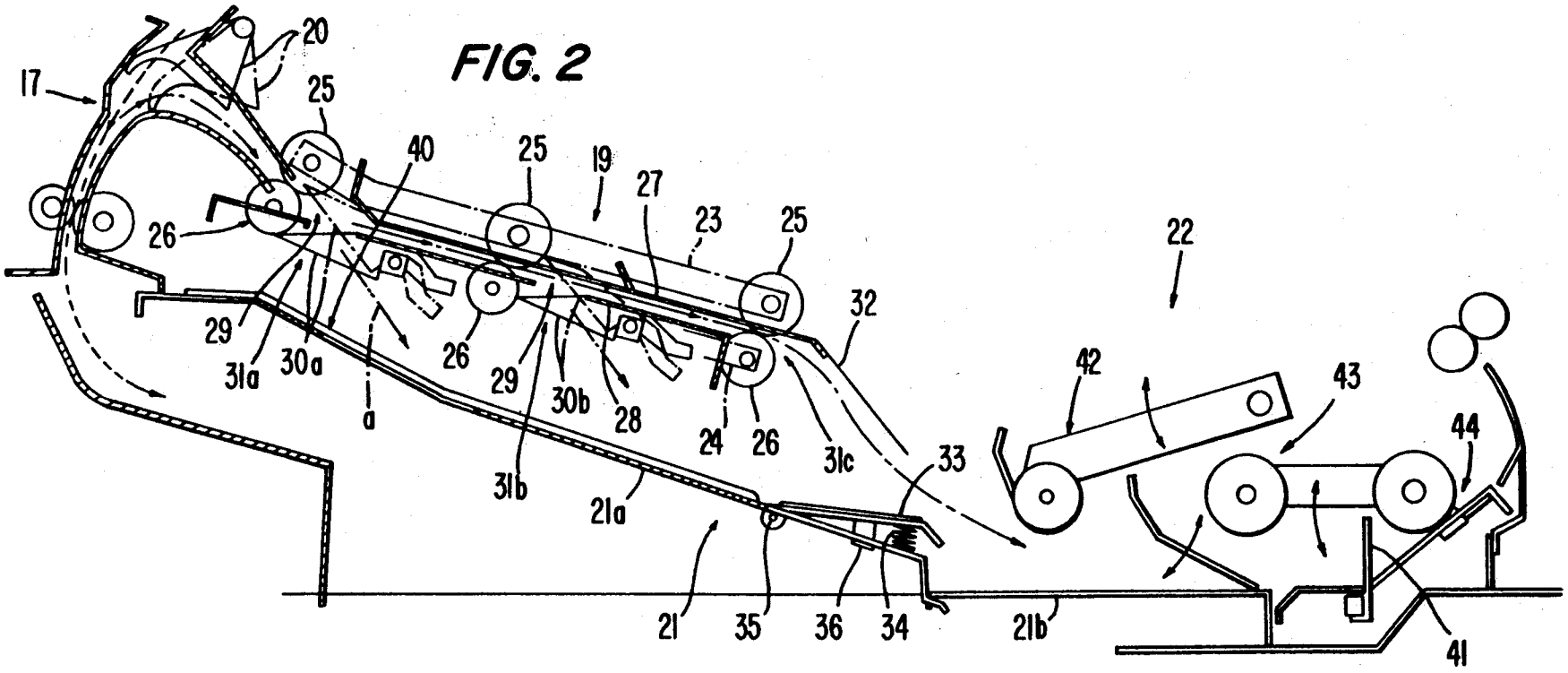
FIG. 2 is a longitudinally sectional side view showing a paper-discharging device and an intermediate tray.

The paper discharging device 19 has the following construction. That is to say, as shown also in FIG. 2, pairs of paper discharging rollers 25, 26 are provided at three positions, i.e. at opposite longitudinal ends and at a longitudinal midway position of a pair of upper and lower frames 23, 24. Paper guiding members 27, 28 are provided between the respective paper discharging rollers 25, 26. Paper discharging portions 29 open downwardly through member 28, immediately downstream of the upstream and midway pairs of paper discharging rollers 25, 26 as viewed in a paper discharging direction.

Paper discharging guides 30*a*, 30*b* are pivotally mounted on the immediate downstream side of the paper discharging portions 29. A paper discharging portion 31*c* composed of the paper discharging rollers 25, 26 at the downstream end is provided with a projecting member 32 for causing discharged papers (a) to turn downwardly.

Paper discharging guides 30*a*, 30*b* both are pivotable between a respective paper-discharging position or posture crossing a paper discharging passage between members 27, 28, thereby discharging a paper (a) into the intermediate tray 21, and a respective position or posture withdrawn from such paper discharging passage, thereby for allowing the paper (a) to pass therethrough in a downstream direction. Large size papers (a) are transferred to the intermediate tray 21 through paper discharging portion 31*a* by pivoting paper discharging guide 30*a*discharging position thereof, shown in dashed lines in FIG. 2. Middle size papers (a) are transferred to intermediate tray 21 through paper discharging portion 31*b* by pivoting paper discharging guide 30*b* to the discharging position thereof, shown in dashed lines in FIG. 2. Small size papers (a) are discharging portion 31*c* at the downstream end by pivoting the two paper discharging guides 30*a*, 30*b* to the withdrawn position thereof, shown in solid lines in FIG. 2.

The intermediate tray 21 comprises an inclined tray portion 21*a* below the paper discharging device 19 and a horizontal tray portion 21*b* separately provided at the downstream end of inclined tray portion 21*a*. The inclined tray portion 21*a* is spaced below the paper discharging device 19 by as great a distance as possible, as long as middle size papers discharged through paper discharging portion 31*b* do not curl in the manner shown in FIG. 8, i.e. do not fall forward.

Figure 4:
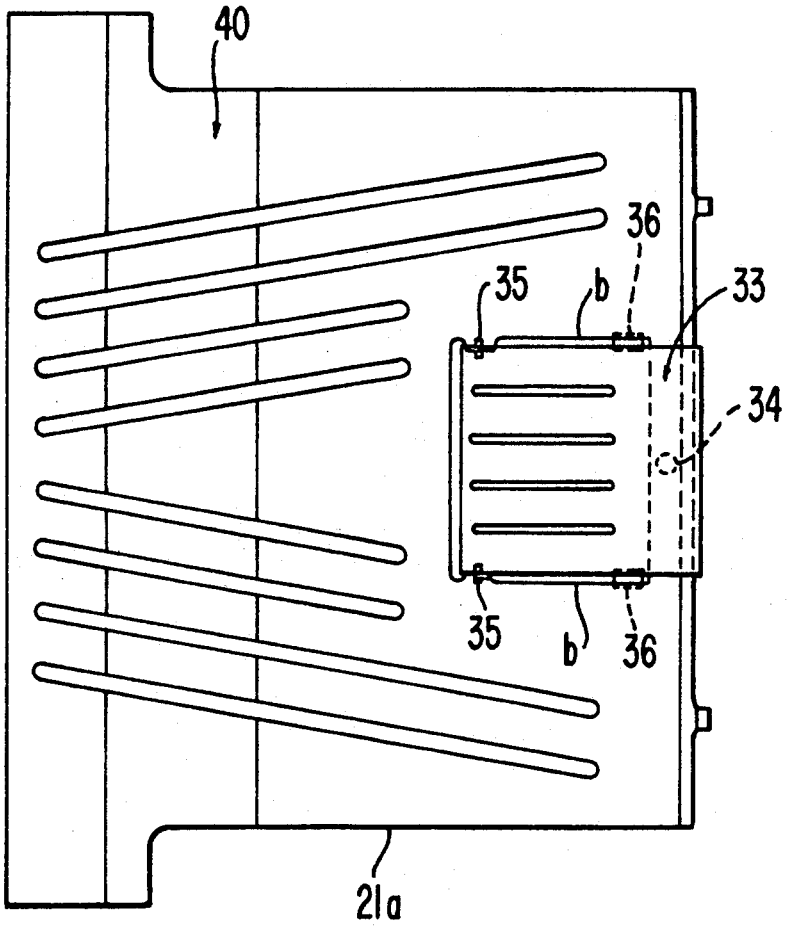
FIG. 4 is a plan view showing an inclined tray portion.
Figure 5:
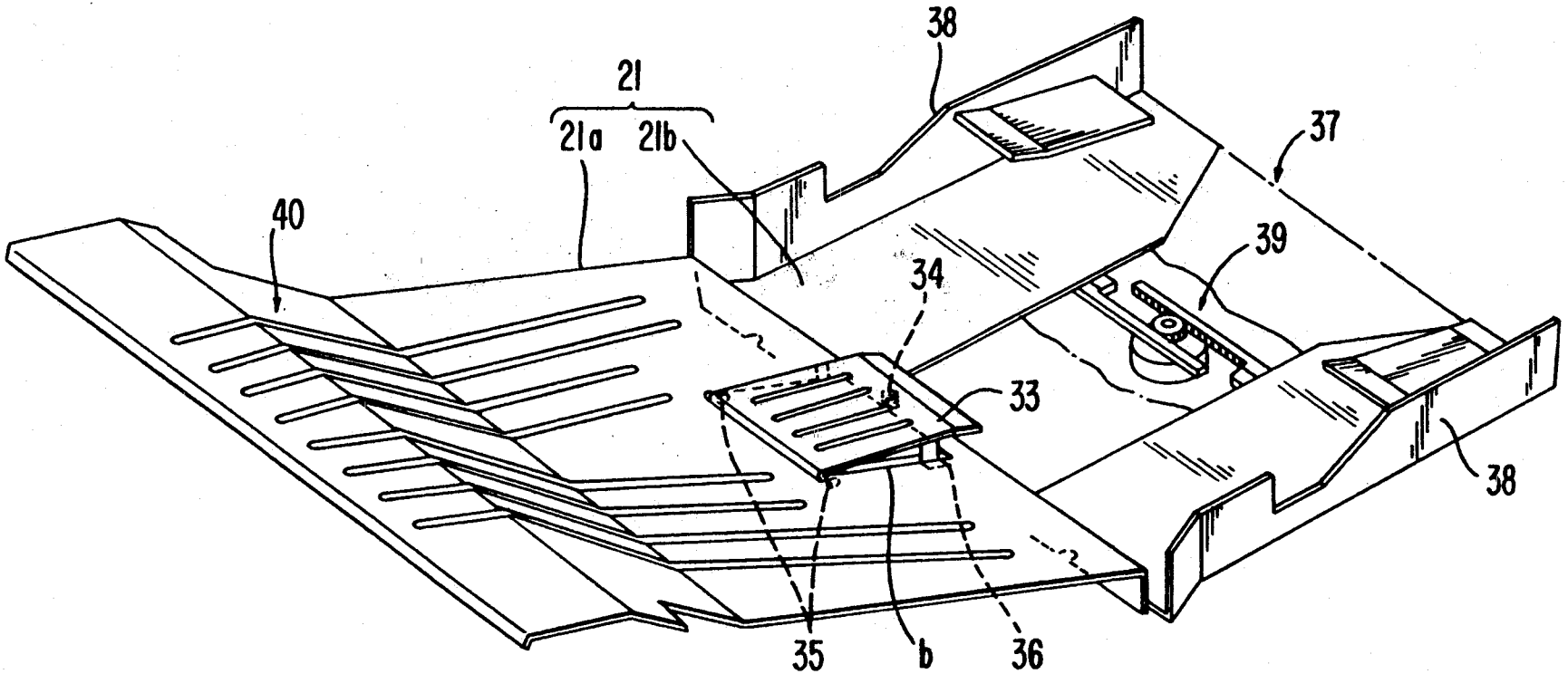
FIG. 5 is a perspective view showing the intermediate tray.

As shown in FIGS. 4 and 5, the inclined tray portion 21*a* is provided with projecting members 40, 33 at positions respectively corresponding to the paper discharging portion 31*a* at the upstream end side in the paper discharging direction and to the paper discharging portion 31*c* at the downstream end in the paper discharging direction. A step is formed between the downstream end of the inclined tray portion 21*a* and the upstream end of horizontal tray portion 21*b*, so that a leading end of a paper being discharged will not catch on a connection portion between tray portions 21*a*, 21*b*.

One projecting member 40 is formed by bending the upstream end, in the paper discharging direction, of the inclined tray portion 21*a*, over the entire width thereof, in a direction toward device 19. Projecting member 33 is provided at a midway portion, in the width direction, of the downstream end, in the paper discharging direction, of the inclined tray portion 21*a*.

In more detail, the projecting member 33 has a plate-like structure provided with ribs member, and is pivoted about a shaft 35 to the inclined tray portion 21*a*, so as to be swingable upwardly and downwardly relative thereto. An energizing member (e.g. a coil spring) 34 energizes the idle downstream end of the projecting member 33 upwardly and mounted between such idle end of the projecting member 33 and the inclined tray portion 21*a*, as shown also in FIG. 3.

The inclined tray portion is provided with longitudinally elongated holes (b) spaced from each other on opposite sides of the projecting member 33. Regulating members 36 to engage with a lower surface of the inclined tray portion 21*a* extend through holes (b) and are connected with the projecting member 33, so that upward pivoting movement of the projecting member 33 relative to inclined tray portion 21*a* may be regulated within a predetermined range.

Width arranging mechanism 37 includes a rack and pinion assembly 39 for moving side plates 38 mounted on horizontal tray portion 21*b* of the intermediate tray 21 toward and away from each other.

Paper resupplying means 22 comprises a positioning stopper 41 for regulating a forward position of the leading ends of papers stacked in the intermediate tray 21. A front collecting roller 42 is rotatably supported for conveying the paper toward stopper 41 every time the intermediate tray 21 is supplied with a paper. A paper supplying roller 43 is rotatably supported by supplying an uppermost paper from the intermediate tray 1 whenever a paper resupplying signal is received Double conveyance-preventing means 44 prevents the supply to paper supplying and conveying device 12 of more than one paper at a time.

Stopper 41 is positioned so that a midway portion in the width direction of the trailing end of a paper will be supported by the projecting member 33 when small size paper is discharged from the paper discharging portion 31*c* and is positioned by stopper 41.

According to the above described construction, jamming of papers between the paper discharging device 19 and the intermediate tray 21 easily can be corrected by separating the inclined tray portion 21*a* from the paper discharging device 19 as much as possible, thus increasing the distance between the paper discharging device 19 and the intermediate tray 21, as long as falling and curling forwardly of middle size paper discharged from the paper discharging portion 31*b* is prevented, and by forming a space below the paper (a) riding on the projecting member 33.

Figure 8:
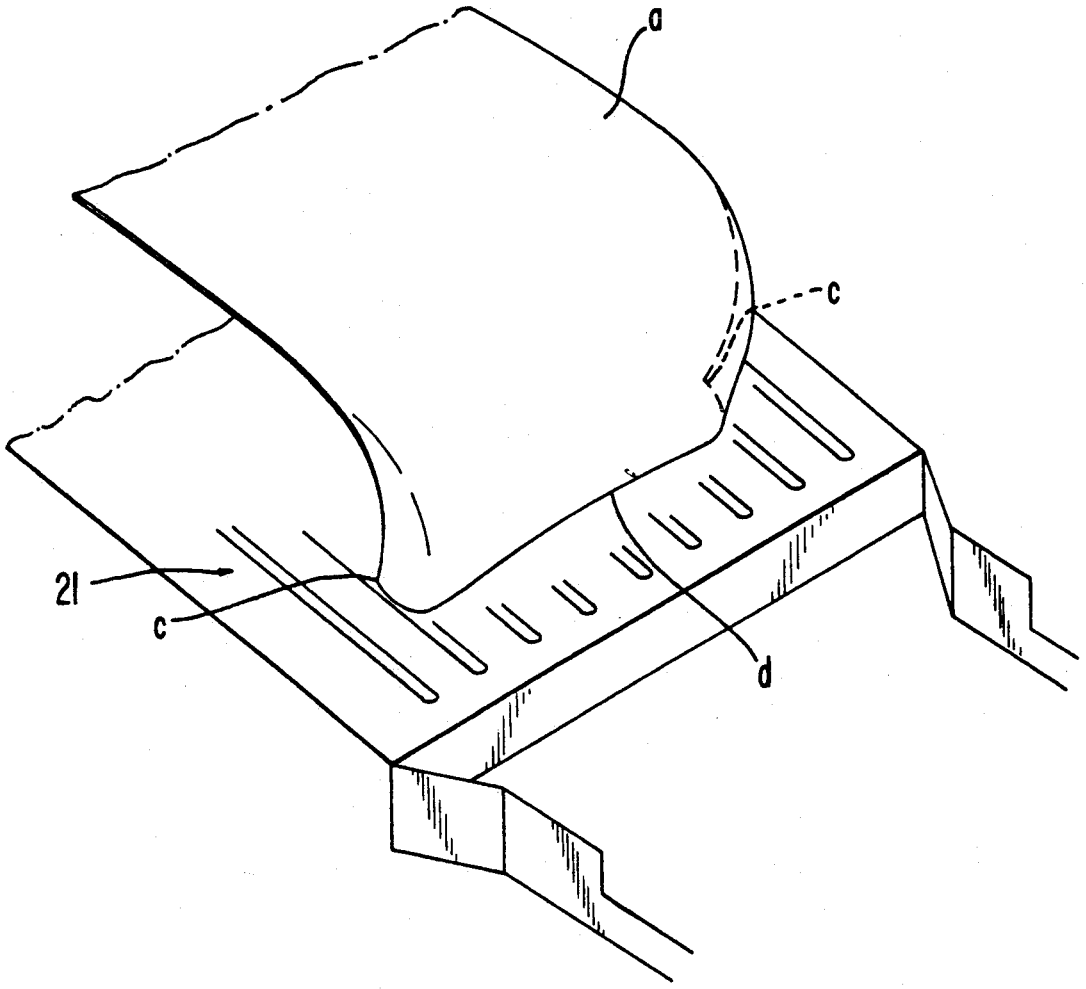
FIG. 8 PRIOR ART
FIG. 8 is a perspective view showing discharge of a paper in a conventional paper-resupplying device.

Papers discharged from a paper discharging portion under the condition that they descend forwardly are liable to further bend or curl forwardly due to a thermal effect from a preceding fixing treatment. Also, both corner portion on the leading end of a paper tend to be bent toward the lower surface of the paper, such that the corner portions (c) curl the leading end of the paper into the shape of turned-over letter "C" as seen from the side of the leading end of the paper. A paper (a) thus tends to curl downwardly and rearwardly, as shown in FIG. 8. The curled portion will be larger than the non-curled portion in the width direction at the leading end side of a small size paper discharged from the paper discharging portion 31*c*, as compared with a large size paper. Thus, small size paper has a greater tendency to be curled in a rear portion thereof, such that the paper will be subject to curling under rearwardly, if the distance from the paper discharging portion 31*c* to the intermediate tray 21 is too large. However, this distance substantially is reduced by providing the projecting member 33. Thus, member 33 effectively reduces the ability of the leading end of the paper to curl or roll downwardly and rearwardly.

Figure 6:
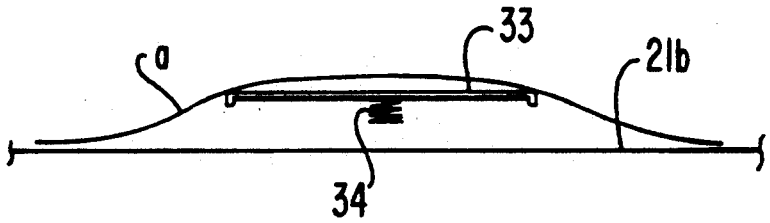
FIG. 6 is a diagram showing operation of a projection member.
Figure 7:
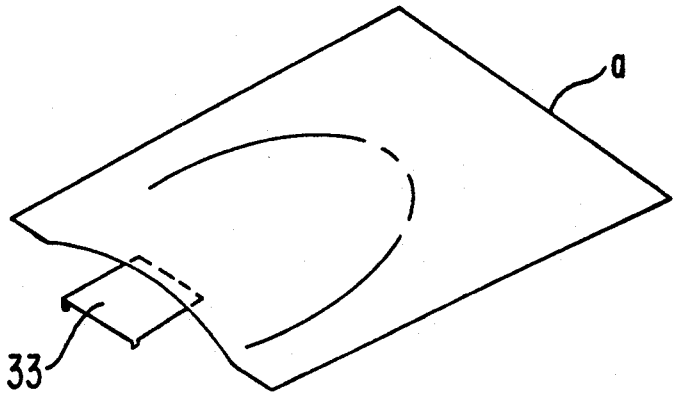
FIG. 7 is a perspective view showing a paper under the condition that a midway portion in the direction of width thereof at a rear end thereof is inflated.

The midway portion in the width direction of the paper (a) is moved upwardly, as shown in FIGS. 6 and 7, by supporting the midway portion at the trailing end of the paper by means of the projecting member 33 and by subjecting the paper to a width arranging operation by the plates 38 of the width arranging mechanism 37. Thus, even when small size papers are transferred to the intermediate tray 21, such papers will be prevented from curling or rolling rearwardly.

Accordingly, even through the paper has a tendency to be curled at the rear end thereof, the paper will be transferred onto the intermediate tray 21 with such curling having been reformed or prevented.

The leading end of the paper is supplied to the horizontal tray portion 21*b*, such that the leading end will form or be aligned in a single plane, and thus such paper is suitably positioned to be resupplied by means of the paper resupplying means 22.

Figure 3:
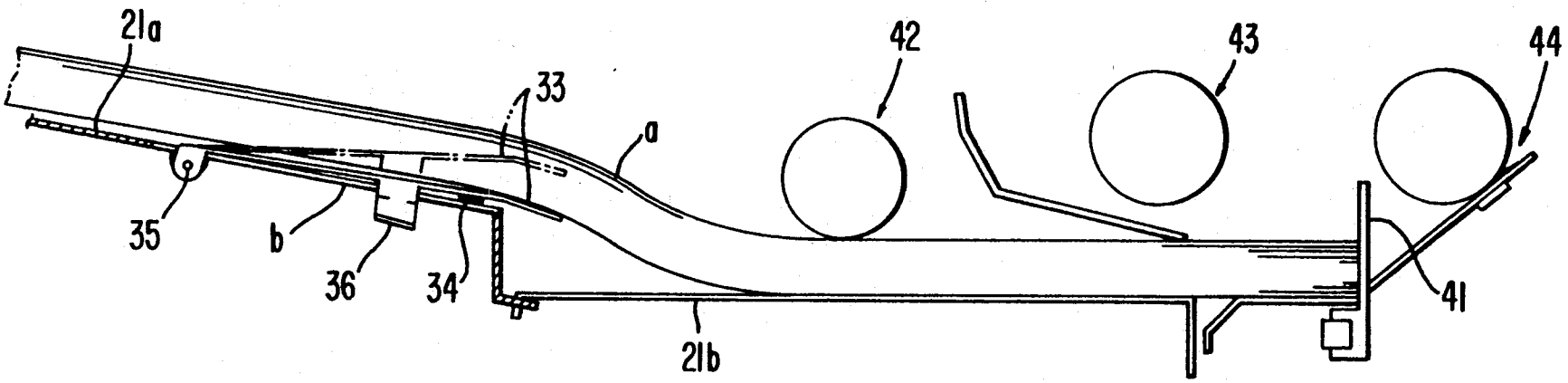
FIG. 3 is a diagram showing principle parts of the intermediate tray in detail.

The energizing member 34 is depressed downwardly with the projecting member 33, as shown in FIG. 3, with an increase of the quantity of the papers (a) stacked in the intermediate tray 21. Thus, the uppermost paper in the intermediate tray 2 always will be at substantially the same position. The spring pressure of the energizing member 34 is selected so that the uppermost paper will be at an almost constant level.

Accordingly, not only the quantity of the papers (a) stacked in the intermediate tray 21 can be increased, but also the jamming easily can be corrected if it occurs. In addition, the projecting member 33 does not hinder the conveyance of the paper, so that the conveyance from the upstream end can be conducted smoothly.

The projecting member 33 may be formed of an elastic member that is bendable upwardly and downwardly, with an upstream end of such elastic member fixedly mounted on the intermediate tray 21, and with a downstream portion of such elastic member positioned above a surface of the tray.

As above described, according to a first aspect of the invention, even though the distance between the paper discharging device and the intermediate tray is increased, the leading end of the paper discharged from the paper discharging portion is relatively raised by the projecting member projected from the intermediate tray, and thus folding and curling downwardly and rearwardly of the paper effectively is prevented.

According to a second aspect of the invention, such folding and curling at the paper discharging portion of small size papers, which are discharged under the worst paper discharging condition, effectively can be prevented by providing the projecting member in correspondence to the paper discharging portion. Accordingly, jamming between the paper discharging device and the intermediate tray easily can be corrected by widening the distance between the paper discharging device and the intermediate tray as much as possible, so long as the paper discharged from other paper discharging portions does not curl downwardly and fall forwardly, or still further widening such distance and simultaneously providing the projecting members in correspondence to the respective paper discharging portions.

When the projecting member is pivotable upwardly and downwardly around the axis extending in the width direction and when an energizing member urges the free or idle end of the projecting member upwardly, not only is curling downwardly and rearwardly prevented, but also the quantity of papers stacked can be increased by the projecting member being pressed downwardly with an increase of the quantity of papers tacked, and simultaneously jamming on stacked papers easily can be corrected and also the conveyance of the paper can be conducted smoothly.

In addition, when the projecting member is arranged midway portion of the width direction of the leading end of the paper, not only is curling downwardly and rearwardly prevented, but also jamming easily can be corrected because of the space formed below the paper riding on the projecting member and because the projecting member does not hinder conveyance of the paper.

Furthermore, when the distance between the paper discharging portion and the intermediate tray is increased toward the downstream end in the paper discharging direction, not only is curling downwardly and rearwardly prevented, but also the quantity of papers stacked can be increased, and simultaneously conveyance of the paper can be conducted smoothly because the inclination of the tray portion in the lower portion of the paper discharging device is increased, and also jamming easily can be corrected.

I claim:

1. A paper resupplying device for an image forming apparatus and comprising:

an intermediate tray for stacking papers having an image formed thereon;

a paper discharging device for discharging the papers to said intermediate tray after the image forming such that the paper falls forwardly; and said intermediate tray comprising an upstream inclined tray portion, a downstream horizontal tray portion, and a projecting member projecting upwardly from said inclined tray portion;

wherein said projecting member is pivoted for movement upwardly and downwardly around an axis extending in the width direction of the paper at an upstream end of said projecting member, and further comprising an energizing member for pivoting upwardly a free end of said projecting member.

2. A paper resupplying device as claimed in claim 1, wherein said paper discharging device is positioned above inclined tray portion.

3. The improvement claimed in claim 1, wherein said intermediate tray is provided with a width arranging mechanism for arranging the papers in the width direction thereof, and paper resupplying means for discharging at a predetermining timing papers stacked on said horizontal portion.

4. The improvement claimed in claim 1, wherein said projecting member is positioned to abut the paper midway of the width of the leading end thereof.

5. The improvement claimed in claim 1, wherein said inclined tray portion is inclined to said paper discharging device such that a distance therebetween increases in a downstream direction.

6. The improvement claimed in claim 1, wherein said projecting member is arranged such that a rear end of the paper will rest on said projecting member when the leading end of the paper is guided by said projecting member at a position allowing the paper to be resupplied, and said energizing member has a spring pressure such that an upper most paper on papers loaded on said intermediate tray will be at substantially a constant level.

7. A paper resupplying device for an image forming apparatus and comprising:

an intermediate tray for stacking papers having an image formed thereon;

a paper discharging device provided with a plurality of paper discharging portions for discharging the papers to said intermediate tray after the image forming;

said paper discharging portions other than a downstream-most paper discharging portion having respective paper-discharging guides, each said guide being movable to a position allowing the paper to pass to said downstream-most paper discharging portion and to be discharged therefrom; and said intermediate tray having projecting therefrom a projecting member to be engaged by a leading end of the paper discharged from said paper discharging device and to guide the paper in a downstream direction;

wherein said projecting member is pivoted for movement upwardly and downwardly around an axis extending in the width direction of the paper at an upstream end of said projecting member, and further comprising an energizing member for pivoting upwardly a free end of said projecting member.

8. A paper resupplying device as claimed in claim 7, wherein said intermediate tray comprises an upstream inclined tray portion and a downstream horizontal tray portion, and said projecting member projects upwardly from said inclined tray portion.

9. A paper resupplying device as claimed in claim 8, wherein said intermediate tray is provided with a width arranging mechanism for arranging the papers in the width direction thereof, and paper resupplying means for discharging at a predetermined timing papers stacked on said horizontal portion.

10. A paper resupplying device as claimed in claim 8, wherein said inclined tray portion is inclined to said paper discharging device such that a distance therebetween increases in a downstream direction.

11. A paper resupplying device as claimed in claim 7, wherein said projecting member is positioned to abut the paper midway of the width of the leading end thereof.

12. A paper resupplying device as claimed in claim 7, wherein said projecting member is arranged such that a rear end of the paper will rest on said projecting member when the leading end of the paper is guided by said projecting member at a position allowing the paper to be resupplied, and said energizing member has a spring pressure such that an uppermost paper of papers loaded on said intermediate tray will be at substantially a constant level.

* * * * *